US010790576B2

(12) United States Patent
Buondelmonte

(10) Patent No.: US 10,790,576 B2
(45) Date of Patent: Sep. 29, 2020

(54) MULTI-BAND BASE STATION ANTENNAS HAVING MULTI-LAYER FEED BOARDS

(71) Applicant: CommScope Technologies LLC, Hickory, NC (US)

(72) Inventor: Charles J. Buondelmonte, Baldwinsville, NY (US)

(73) Assignee: CommScope Technologies LLC, Hickory, NC (US)

( * ) Notice: Subject to any disclaimer, the term of this patent is extended or adjusted under 35 U.S.C. 154(b) by 455 days.

(21) Appl. No.: 15/378,369

(22) Filed: Dec. 14, 2016

(65) Prior Publication Data

US 2017/0170549 A1 Jun. 15, 2017

Related U.S. Application Data

(60) Provisional application No. 62/266,948, filed on Dec. 14, 2015.

(51) Int. Cl.

| | |
|---|---|
| ***H01Q 7/00*** | (2006.01) |
| ***H01Q 1/24*** | (2006.01) |
| ***H01Q 15/14*** | (2006.01) |
| ***H01Q 21/00*** | (2006.01) |
| ***H01Q 21/08*** | (2006.01) |
| ***H01Q 21/28*** | (2006.01) |
| *H01Q 3/26* | (2006.01) |

(52) U.S. Cl.

CPC ..... *H01Q 1/246* (2013.01); *H01Q 15/14* (2013.01); *H01Q 21/0075* (2013.01); *H01Q 21/08* (2013.01); *H01Q 21/28* (2013.01); *H01Q 3/26* (2013.01)

(58) Field of Classification Search

CPC .... H01Q 1/246; H01Q 15/14; H01Q 21/0075; H01Q 21/08; H01Q 21/28; H01Q 3/26

See application file for complete search history.

(56) References Cited

U.S. PATENT DOCUMENTS

| | | | | |
|---|---|---|---|---|
| 5,872,545 | A * | 2/1999 | Rammos | H01Q 21/0075 343/700 MS |
| 5,905,465 | A * | 5/1999 | Olson | H01Q 1/246 33/34 |
| 6,067,053 | A * | 5/2000 | Runyon | H01Q 1/246 343/700 MS |
| 6,239,762 | B1 | 5/2001 | Lier | |
| 6,307,525 | B1 | 10/2001 | Bateman et al. | |
| 6,339,407 | B1 * | 1/2002 | Gabriel | H01Q 1/246 343/797 |
| 6,535,168 | B1 | 3/2003 | Marumoto et al. | |
| 6,856,300 | B2 | 2/2005 | McCarrick | |
| 7,075,485 | B2 | 7/2006 | Song et al. | |

(Continued)

FOREIGN PATENT DOCUMENTS

| | | | |
|---|---|---|---|
| EP | 0958636 B1 * | 4/2006 | H01Q 21/06 |

*Primary Examiner* — Daniel Munoz
*Assistant Examiner* — Bamidele A Jegede
(74) *Attorney, Agent, or Firm* — Myers Bigel, P.A.

(57) ABSTRACT

Aspects of the present disclosure may be directed to a multi-layer feed-board with all the functional components, including phase shifters, diplexers, and dipole element, employed thereon. Therefore, solder interfaces at cable to functional component interfaces are no longer necessary. Instead, component interfaces are within the confines of the multi-layer feed-board, thereby reducing PIM issues attributed to solder joint interfaces.

20 Claims, 14 Drawing Sheets

(56) References Cited

U.S. PATENT DOCUMENTS

| | | | | |
|---|---|---|---|---|
| 7,265,719 | B1 | 9/2007 | Moosbrugger et al. | |
| 7,525,504 | B1 | 4/2009 | Song et al. | |
| 7,834,808 | B2 | 11/2010 | Thompson et al. | |
| 7,880,677 | B2 | 2/2011 | Rofougaran et al. | |
| 8,044,861 | B2 | 10/2011 | Pedersen et al. | |
| 8,111,196 | B2 | 2/2012 | Thiam et al. | |
| 8,179,323 | B2 | 5/2012 | Shamblin et al. | |
| 8,217,839 | B1 | 7/2012 | Paulsen | |
| 8,674,895 | B2 | 3/2014 | Timofeev | |
| 8,704,727 | B2 | 4/2014 | Cruz et al. | |
| 8,786,496 | B2 | 7/2014 | Rida et al. | |
| 8,941,540 | B2 | 1/2015 | Harper et al. | |
| 2003/0011529 | A1* | 1/2003 | Gottl | H01Q 1/246 343/795 |
| 2004/0150561 | A1* | 8/2004 | Tillery | H01Q 1/085 343/700 MS |
| 2005/0012665 | A1* | 1/2005 | Runyon | H01Q 1/246 342/372 |
| 2005/0057417 | A1* | 3/2005 | Teillet | H01Q 1/246 343/797 |
| 2005/0253769 | A1* | 11/2005 | Timofeev | H01Q 1/246 343/797 |
| 2006/0114168 | A1* | 6/2006 | Gottl | H01Q 1/246 343/797 |
| 2008/0036665 | A1* | 2/2008 | Schadler | H01Q 1/42 343/700 MS |
| 2009/0096700 | A1* | 4/2009 | Chair | H01Q 1/246 343/797 |
| 2010/0265150 | A1* | 10/2010 | Arvidsson | H01Q 1/246 343/837 |
| 2011/0043425 | A1* | 2/2011 | Timofeev | H01Q 1/246 343/817 |
| 2012/0280878 | A1* | 11/2012 | Timofeev | H01Q 1/246 343/793 |
| 2014/0313094 | A1* | 10/2014 | Berezin | H01Q 1/521 343/810 |
| 2015/0200467 | A1 | 7/2015 | Kurk et al. | |

* cited by examiner

MULTI-BAND BASE STATION ANTENNAS HAVING MULTI-LAYER FEED BOARDS

CROSS-REFERENCE TO RELATED APPLICATION

The present application claims priority under 35 U.S.C. 119 to U.S. Provisional Patent Application Ser. No. 62/266,948, filed Dec. 14, 2015, the entire content of which is incorporated herein by reference as if set forth in its entirety.

BACKGROUND

Antennas operating in certain frequency bands may include an array of radiating elements connected by a feed network. The feed network may include a series of functional components that are positioned on various feed boards that are coupled together with coaxial cables. Solder joints are often used as interfaces to connect the coaxial cables to the functional components of the various feed boards. To accommodate increasing wireless demands, antennas are increasing in complexity, resulting in more functional components and more solder joint interfaces electrically connecting the same, among the various feed boards, increasing susceptibility to passive intermodulation (PIM) issues.

SUMMARY OF THE DISCLOSURE

Various aspects of the present disclosure may be directed to multi-band antennas that transmit and receive signals in at least two different frequency bands that include multi-layer feed board with the functional components, including phase shifters, diplexers, and dipole element, employed thereon. Therefore, solder interfaces at cable-to-functional component interfaces are no longer necessary. Instead, component interfaces are within the confines of the multi-layer feed board, thereby reducing PIM issues attributed to solder joint interfaces.

BRIEF DESCRIPTION OF THE DRAWINGS

The following detailed description of the disclosure will be better understood when read in conjunction with the appended drawings. For the purpose of illustrating the disclosure, example embodiments are shown in the drawings. It should be understood, however, that the disclosure is not limited to the precise arrangements and instrumentalities shown in the drawings.

DETAILED DESCRIPTION OF VARIOUS EMBODIMENTS

Figure 1A:
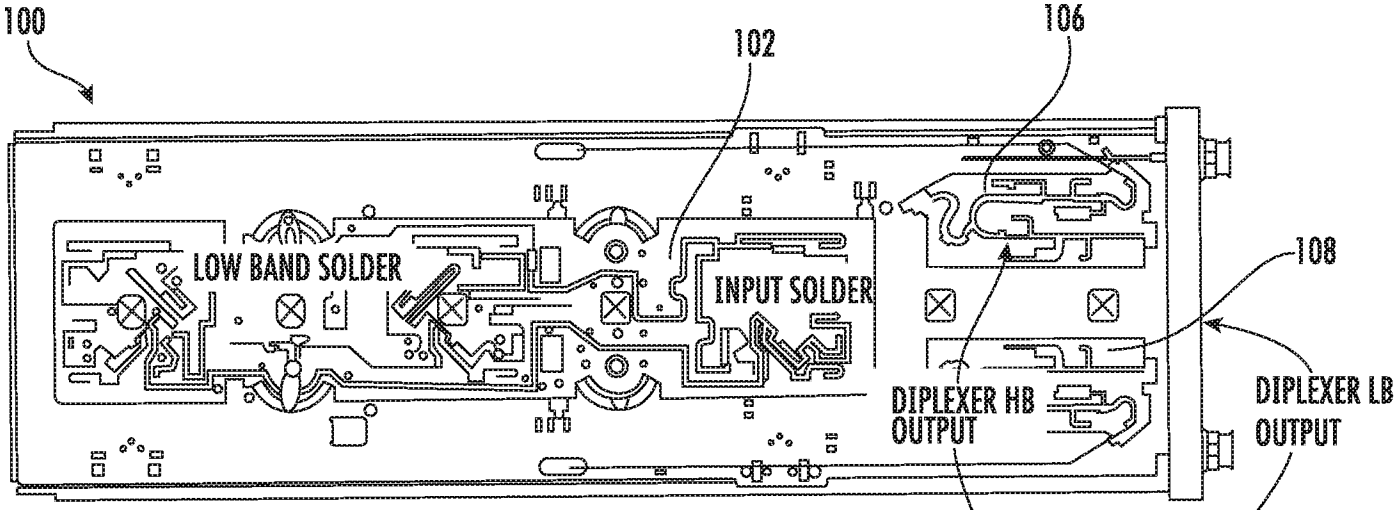
FIGS. 1A and 1B are plan views of examples of double-sided feed boards of a base station antenna in a multiple multi-layer feed board arrangement, according to an aspect of the present disclosure.

Certain terminology is used in the following description for convenience only and is not limiting. The words "lower," "bottom," "upper" and "top" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import. It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Antennas operating in certain frequency bands (e.g., 880-960 MHz, 1710-1880 MHz, 1920-2170 MHz, 2.5-2.7 GHz, 3.4-3.8 GHz, etc.) may include an array of radiating elements that is connected to one or more radios by a feed network. The feed network may include a series of functional components that are positioned on various feed boards. The feed boards are coupled together with coaxial cables. For example, phase shifters, diplexers, power dividers, and other antenna components may be implemented on different feed boards (e.g., printed circuit boards) of antennas (e.g., base station antennas). The number of antenna components as well as the number of feed boards may increase as the complexity of the antenna increases. For example, to accommodate increased wireless traffic, some antennas, which are referred to herein as "multi-band" antennas, may be configured to operate in more than one frequency band. Solder joint interfaces may electrically connect the antenna components on the various feed boards.

Figure 1B:
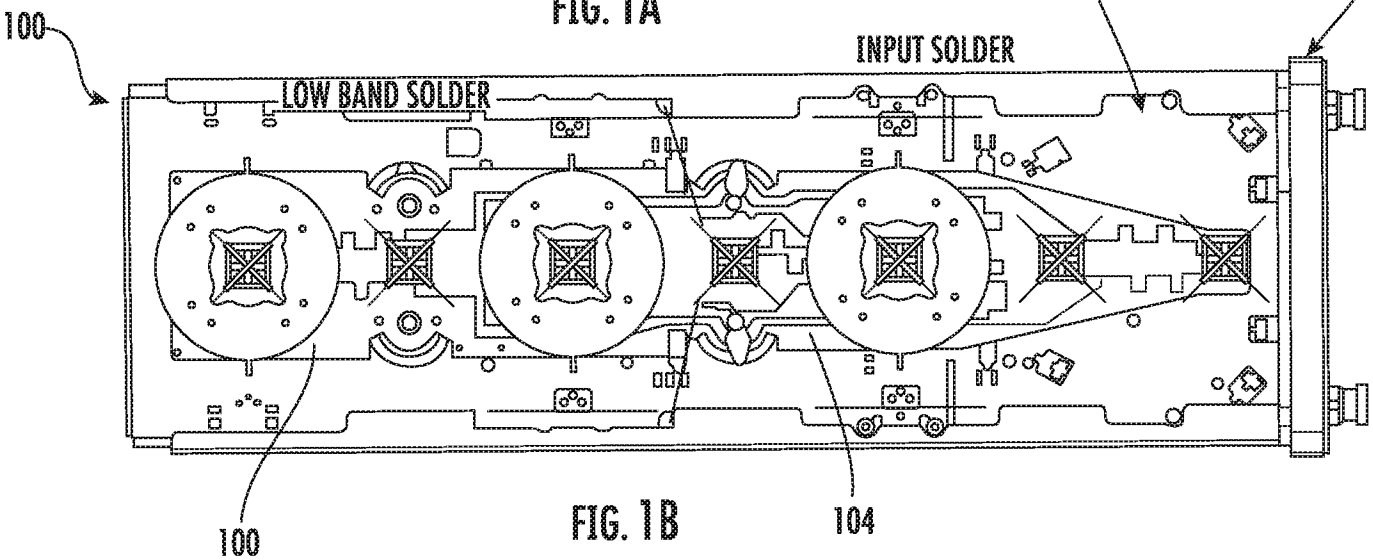

For example, referring to FIGS. 1A and 1B, plan views of two double-sided feed boards of a base station antenna 100 are respectively shown. More specifically, as shown in FIG. 1A, one double-sided feed board 102 includes conductive traces for signaling operation in one frequency band (e.g., a low band), and another double-sided feed board 104 (shown in FIG. 1B) includes conductive traces for signaling operation in another frequency band (e.g., a high band). With such a configuration, two diplexer boards 106, 108 (as shown in FIG. 1A) may also be necessary. Consequently, in total, at least four boards are employed. Portions of these boards may need to be connected to one another through solder joints. Even though several of these boards employ multiple layers to implement components on the same feed board (and thus exhibit some of the same benefits of other aspects of the present disclosure described below), there are nonetheless many solder joints used to connect the antenna components implemented on the different feed boards. In other designs, an increased number of printed circuit boards are required, and, in turn, a greater number of solder joints may be required to connect the antenna components. Solder joints are known to be a source of passive intermodulation (PIM) instability, potentially decreasing the yield in the fabrication of the antenna. Moreover, solder joints are typically constructed by hand ("hand soldering"). Hand soldering is known to be a tedious process and can increase variability in electrical interfaces.

Figure 2:
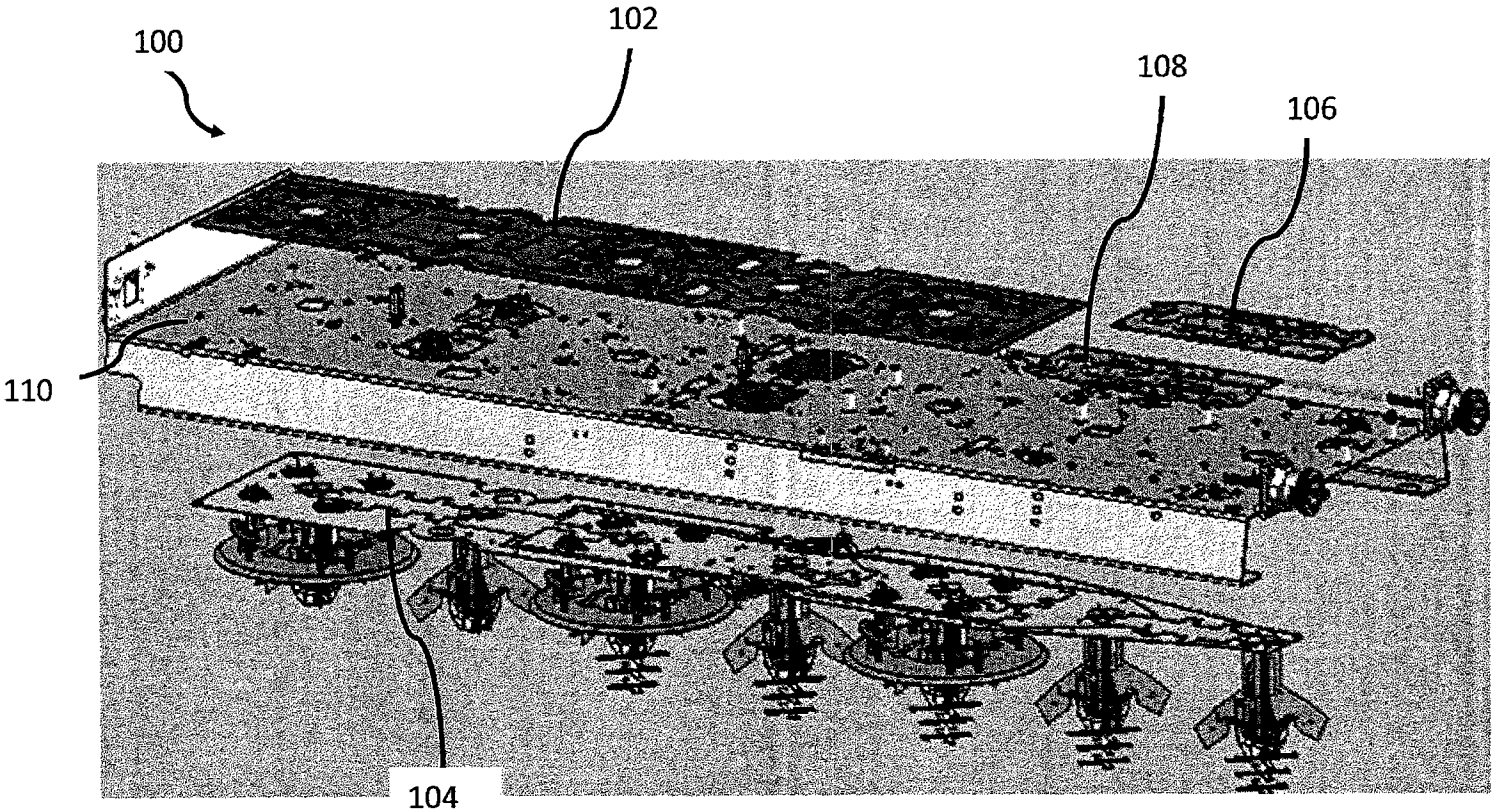
FIG. 2 is an exploded perspective view of the base station antenna of FIGS. 1A and 1B, according to an aspect of the present disclosure.

FIG. 2 is an exploded perspective view of the base station antenna 100 of FIGS. 1A and 1B. As shown, the low band feed board 102 is positioned on one side of a reflector 110 of the base station antenna 100, while the high band feed board 104 is positioned on the other side of the reflector 110. Such a configuration may result in high back radiation, or radiation in a direction opposite the main lobe.

Figure 3:
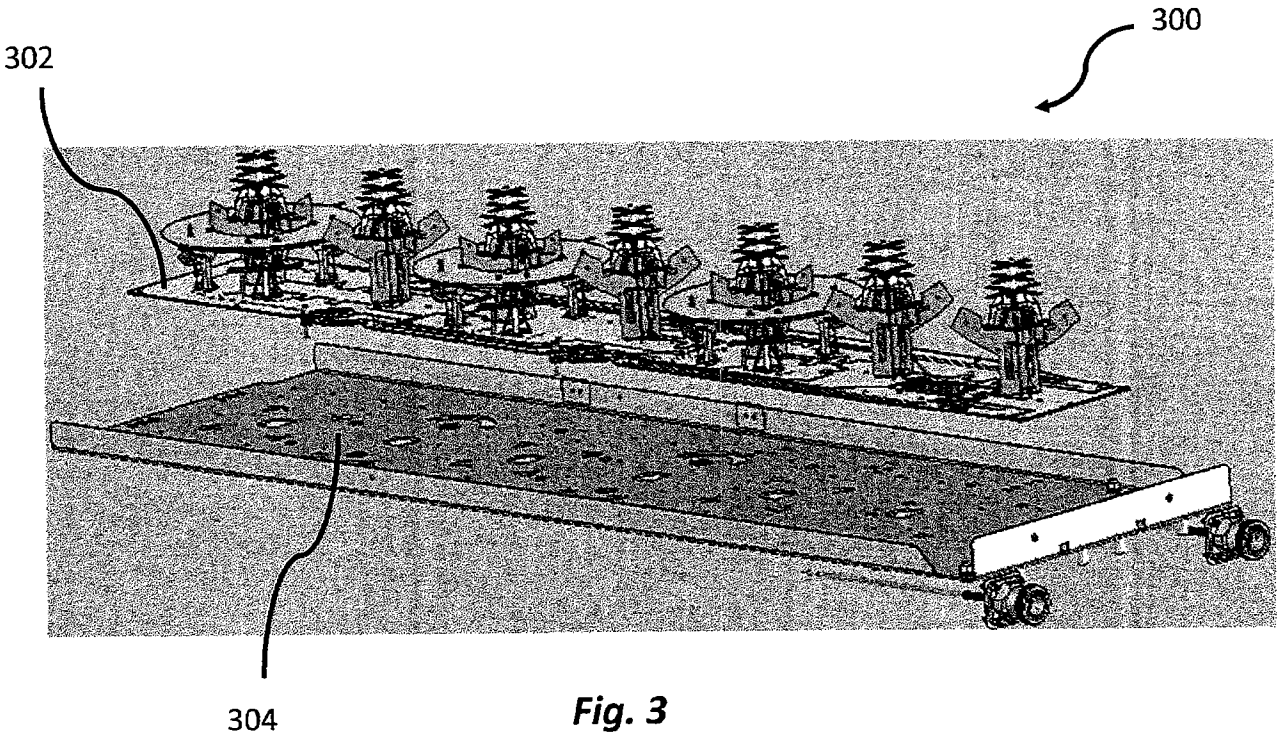
FIG. 3 is an exploded perspective view of a base station antenna employing a single multi-layer feed board according to an aspect of the present disclosure.

FIG. 3 is an exploded perspective view of a multi-band base station antenna 300 that is implemented using a single multi-layer feed board 302 with all the functional components, including phase shifters, diplexers, and radiating elements, employed thereon. For example, antenna components associated with operation in a first frequency band, as well as antenna components associated with operation in a second frequency band may be employed on the same multi-layer feed board 302 on one side of a reflector 304. Therefore, the number of solder interfaces at cable-to-functional component interfaces may be reduced since these component interfaces may be within the confines of the multi-layer feed board 302. This may reduce PIM issues attributed to solder joint interfaces. Any remaining essential solder joints may be constructed via an automated soldering process, such as a selective wave flow soldering process.

Figure 4B:
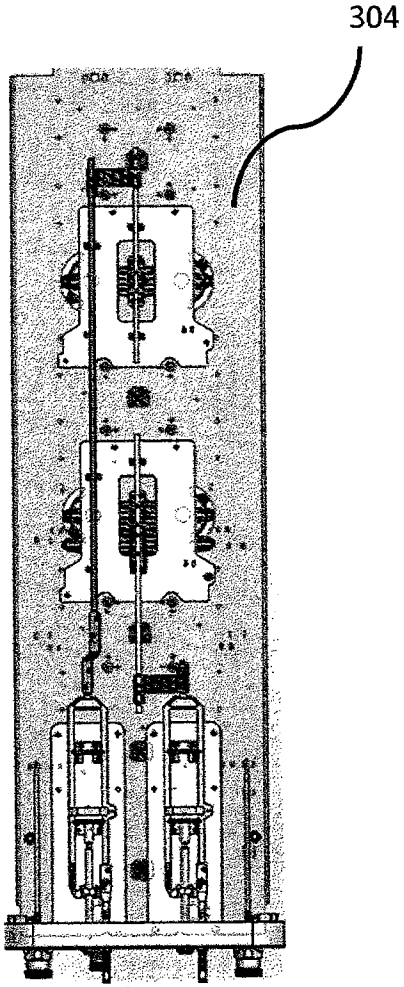
FIGS. 4A and 4B are plan views of back and front sides of a reflector of the base station antenna according to an aspect of the present disclosure.
Figure 4A:
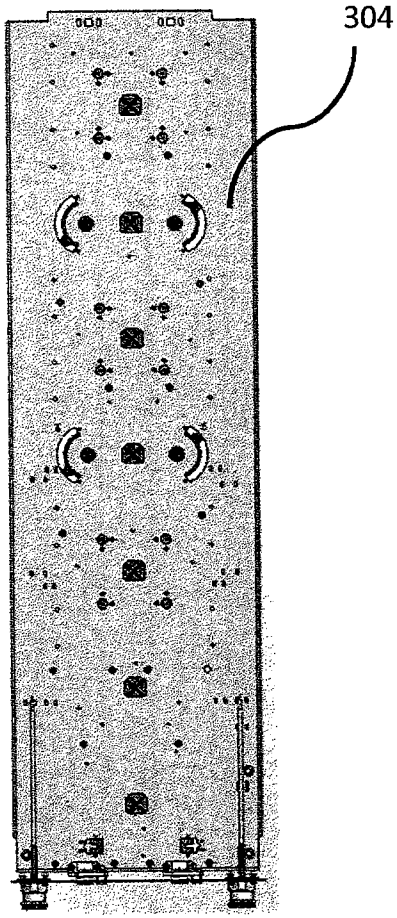

FIGS. 4A and 4B are plan views of back and front sides of the reflector 304, respectively, of the base station antenna 300, according to an aspect of the present disclosure. As shown in FIGS. 4A and 4B, there is no feed board on the opposite side of the reflector 304, reducing the likelihood of any PIM issues due to back radiation.

Figure 5A:
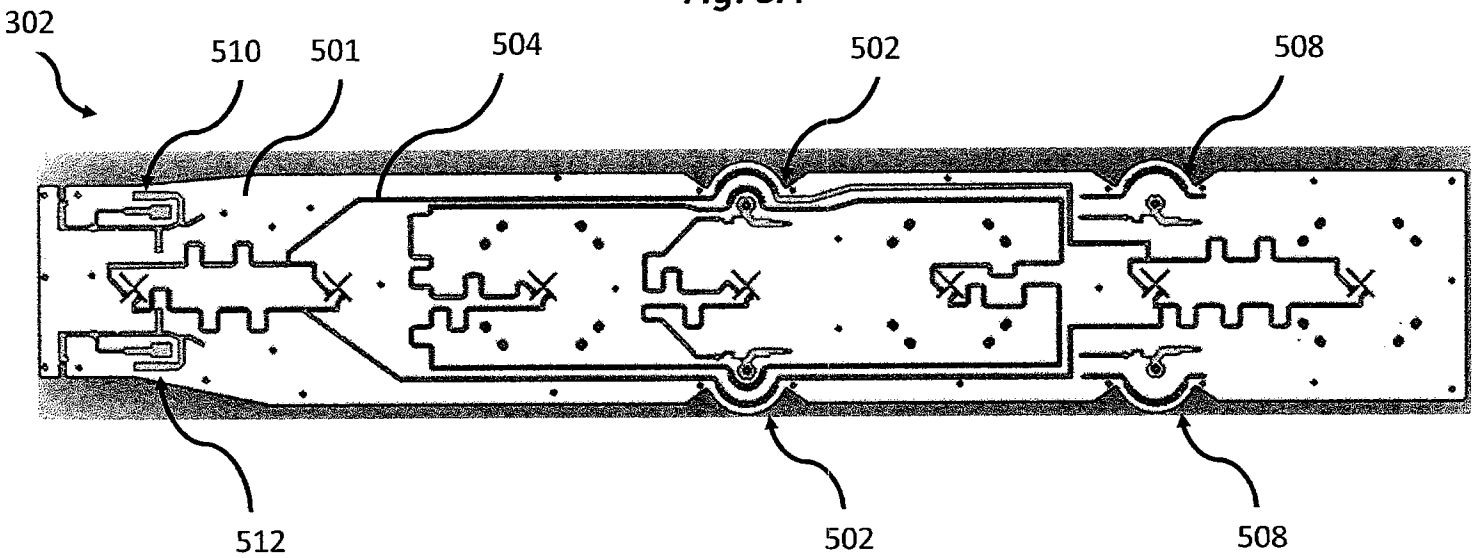
FIGS. 5A and 5B are plan views of first and third layers, respectively, of the multi-layer feed board according to an aspect of the present disclosure.
Figure 5B:
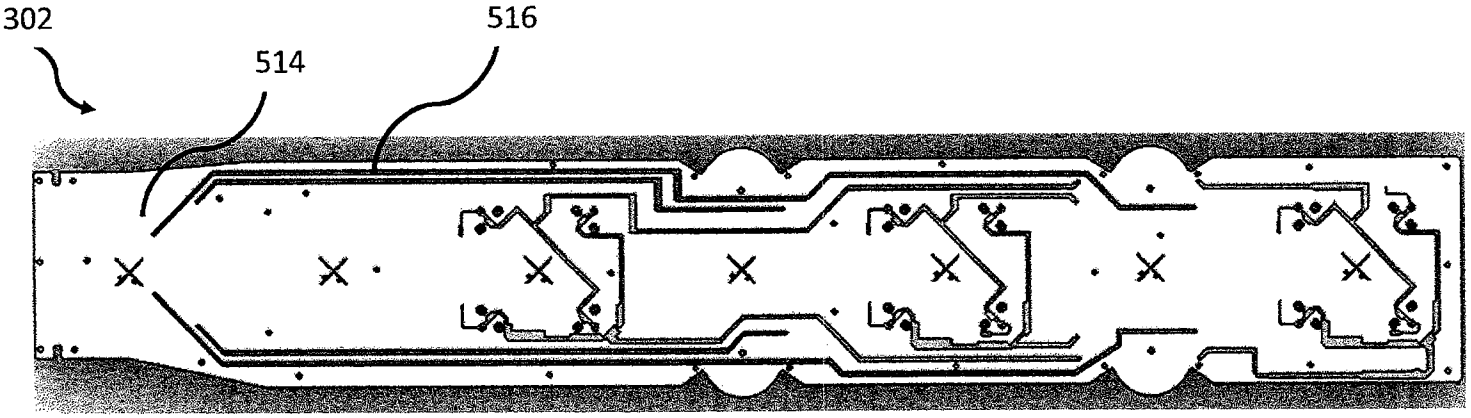

Referring to FIGS. 5A and 5B, various layers of the multi-layer feed board 302 are illustrated. FIG. 5A is a plan view of a first layer 501 (e.g., a top layer) of the multi-layer feed board 302. The first layer 501 includes a plurality of microstrip transmission lines ("conductive traces") 504 that electrically connect various antenna components including first frequency band phase shifters 502 for phase shifting first frequency band signals. The first layer conductive traces 504 may electrically couple outputs of the first frequency band phase shifters 502 to first frequency band radiating elements 506 (shown in FIGS. 8A and 8B). The first frequency band phase shifters 502 may be configured to phase shift sub-components of the first frequency band signals. Also located on the first layer are second frequency band phase shifters 508 for phase shifting sub-components of second frequency band signals, and first and second diplexers 510, 512. The first and second frequency band phase shifters 502, 508 may be implemented using printed circuit board fabrication techniques. Rotatable wiper arms for the first and second frequency band phase shifters 502, 508 are not illustrated to enhance clarity of the fixed portions of the first and second frequency band phase shifters 502, 508. The first and second frequency band phase shifters 502, 508 may comprise variable differential, arcuate phase shifters as described in U.S. Pat. No. 7,907,096, which is incorporated herein by reference. It should be noted, however, that the first and second frequency band phase shifters 502, 508 may take the form of other types of phase shifters in keeping with the disclosure. Having the first and second diplexers 510, 512 as well as the first and second frequency band phase shifters 502, 508 on the same feed board 302 may eliminate the need for additional solder joint interfaces among multiple feed boards.

FIG. 5B is a plan view illustrating another layer, e.g., a third layer 514 (e.g., located below the first layer) of the same feed board 302. As shown, third layer conductive traces 516 may electrically connect various components including outputs of the second frequency band phase shifters 508 to second frequency band radiating elements 518 (shown in FIGS. 8A and 8B) associated with a second frequency band operating range of the base station antenna 300.

Figures 6A, 6B:
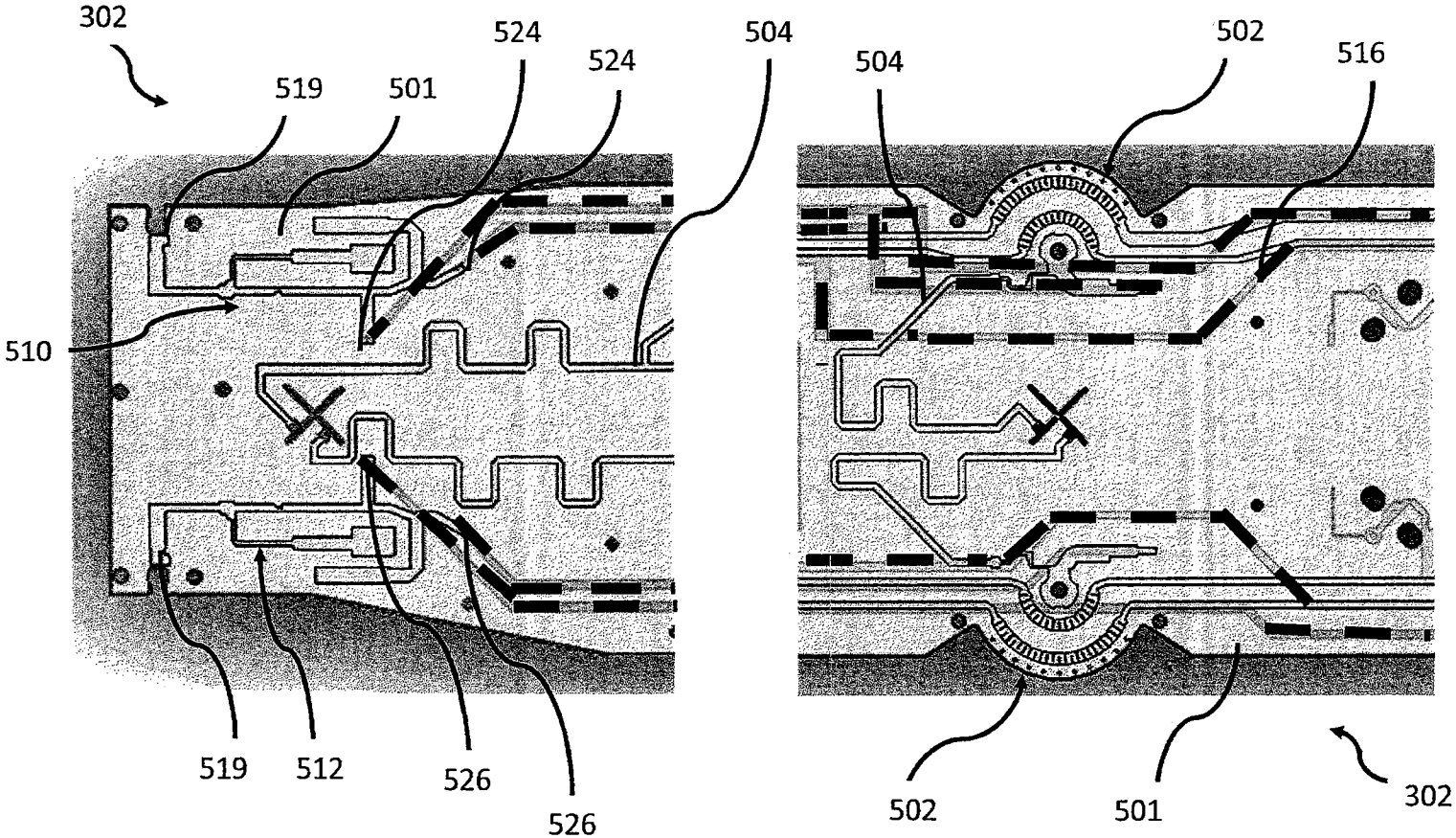
FIG. 6A is an enlarged view of a portion of the first layer and the third layer of the multi-layer feed board, according to an aspect of the present disclosure.
FIG. 6B is an enlarged view of another portion of the first layer and the third layer of the multi-layer feed board, according to an aspect of the present disclosure.

FIG. 6A is an enlarged view of a portion of the first layer 501 including the first layer conductive traces 504 of FIG. 5A, with third layer conductive traces 516 (shown in dashed lines). Input cable solder joint locations 519 are shown. Coaxial cables may be mounted at these input cable solder joint locations 519 and soldered in place to physically and electrically attach such cables to the multi-layer feed board 302. The input cable solder joint locations 519 are electrically connected to respective inputs of the first and second diplexers 510, 512. Plated through holes may be employed to connect respective outputs 524, 526 of the first and second diplexers 510, 512 to the third layer conductive traces 516.

FIG. 6B is an enlarged view of another portion of the first layer 501 of the multi-layer feed board 302. Plated though holes may also be employed to electrically couple one or more outputs of the first and second diplexers 510, 512 (as shown in FIG. 6A) to respective inputs of the first band phase shifters 502. Other outputs of the first and second diplexers 510, 512 may be connected to the second band phase shifters 508 (shown in FIG. 5A).

Figure 6D:
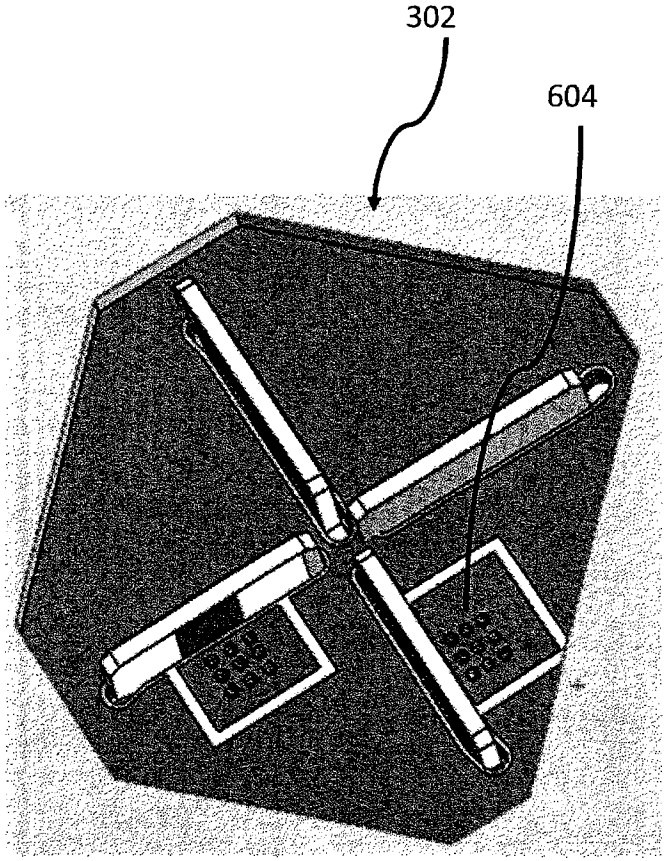
FIG. 6D is an enlarged view of a portion of an underside of the multi-layer feed board according to an aspect of the present disclosure.
Figure 6C:
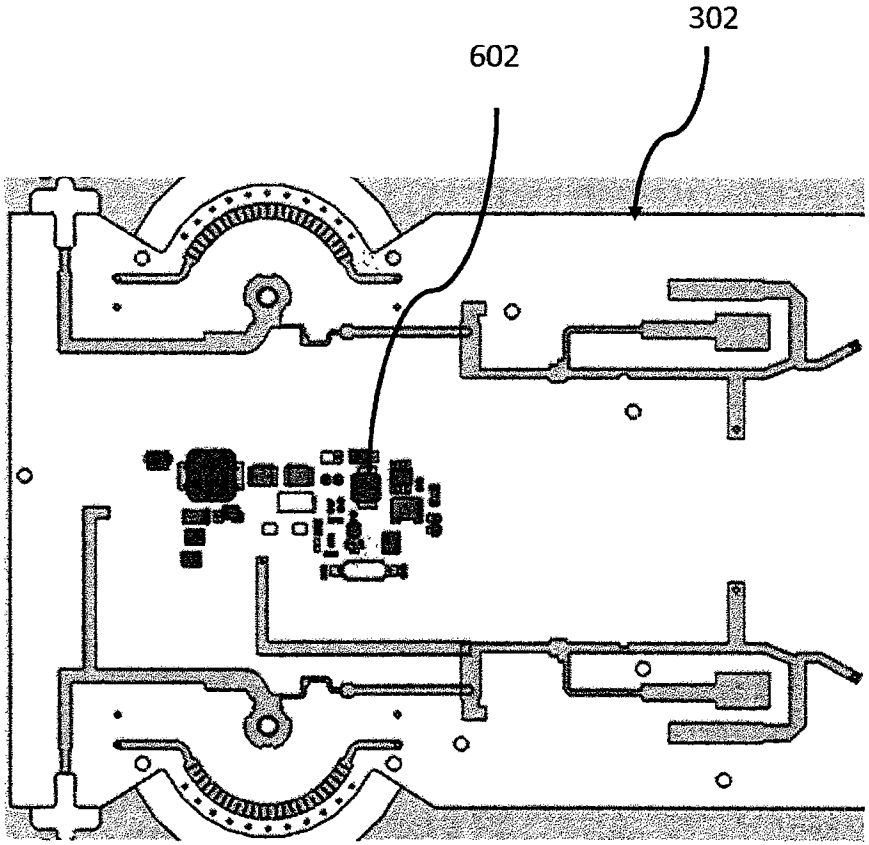
FIG. 6C is an enlarged view of a portion of the multi-layer feed board incorporating actuation systems, according to an aspect of the present disclosure.

As shown in FIG. 6C, the multi-layer feed board 302 may incorporate actuation systems for remote electrical tilt, a lightning protection module (which may hold AISG connectors as well as circuitry that protects the system from voltage surges such as lightning strikes), and/or a combined smart bias Tee 602, which may also serve to eliminate electrical interfaces, cables, and connectors. These components, as well as one or more others discussed herein, may be mounted to the multi-layer feed board 302 through surface mounting, and reflow soldering techniques. After reflow soldering, the multi-layer feed board 302 may be subjected to a selective wave flow solder process to solder the radiating elements 506, 518 to the multi-layer feed board 302. Using techniques such as selective wave flow soldering, the temperature of the multi-layer feed board 302 may remain relatively low during the soldering, thus preventing the components from again reflowing. Also, input connectors can be soldered to the multi-layer feed board 302 during wave soldering to eliminate additional hand solder joints and improve PIM, reliability and assembly time.

As shown in FIG. 6D, one or more plated through holes 604 may be employed to connect conductive traces to a ground layer for allowing wave soldering at a bottom side of the multi-layer feed board 302.

Figure 7:
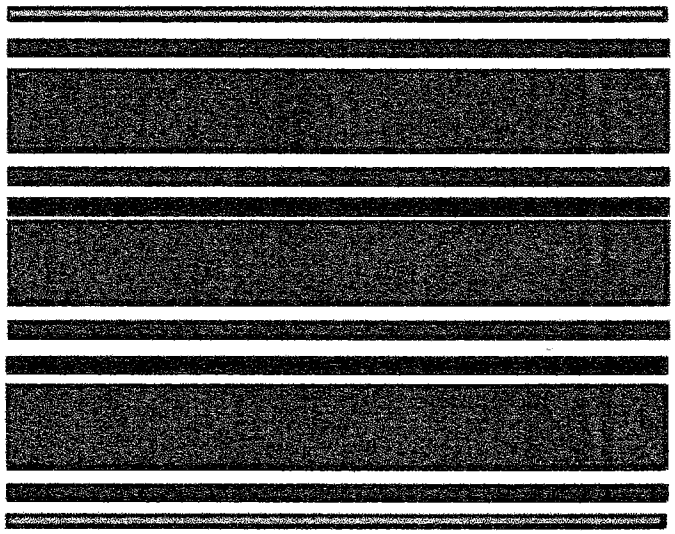
FIG. 7 is an illustration of an example of a stack up of the multi-layer feed board according to an aspect of the present disclosure.

FIG. 7 is an illustration of a stack-up of the multi-layer feed board 302 according to an aspect of the present disclosure. The multi-layer feed board 302 may comprise layers of different materials stacked on top of each other, which include the above discussed first signal layer ("Layer 1") and third signal layer ("Layer 3"). These layers, along with other layers, which may be ground layers, such as Layer 2 and Layer 4, may take the form of copper microstrip lines. These four layers may be separated by other layers, such as insulating layers. Having multiple routing layers allows for isolation between high frequency band and low frequency band signals as well as avoidance of the need to cross over conductive traces.

Figure 8A:
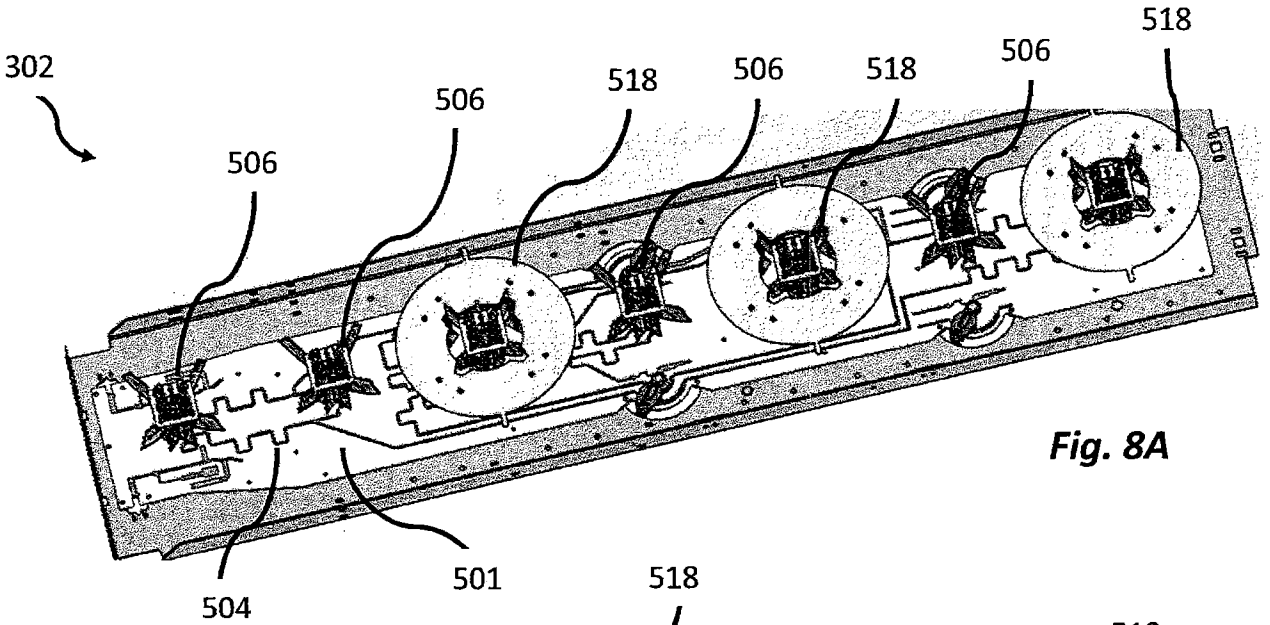
FIGS. 8A and 8B are perspective views of the multi-layer feed board according to an aspect of the present disclosure.
Figure 8B:
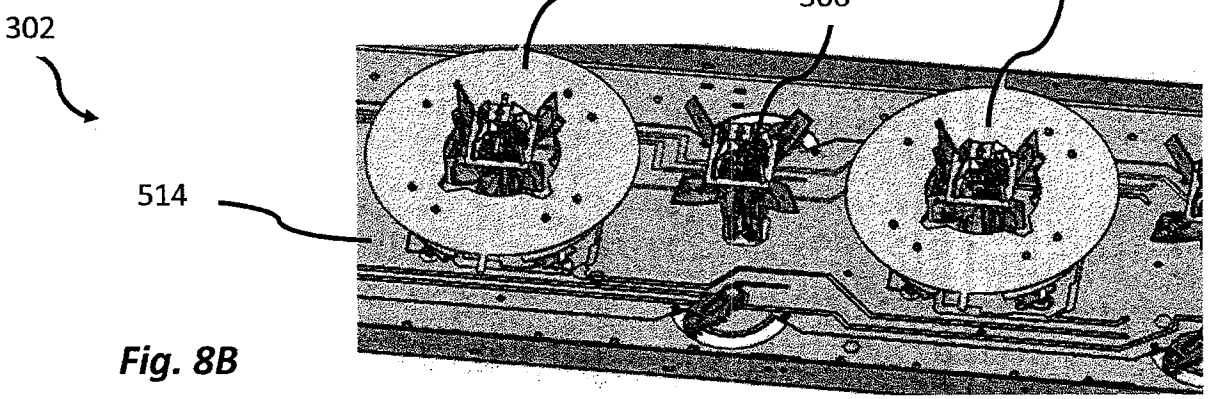

FIGS. 8A and 8B are perspective views of the multi-layer feed board 302 with various radiating elements 506, 518 mounted thereon. The first set of radiating elements 506 may comprise, for example, a first linear array of crossed dipole elements and may be dimensioned for transmission and/or reception of radio frequency (RF) signals in the first frequency band. The second set of radiating elements 518 may comprise a second linear array of microstrip annular ring elements arranged on a longitudinal axis, and may be dimensioned to transmit and/or receive RF signals in the second frequency band. In this example, the first set of radiating elements 506 may comprise high band elements (e.g., for operation in frequency band 1695-2690 MHz). The second set of radiating elements 518 may comprise low band elements (e.g., for operation in frequency band 694-960 MHz). The first layer conductive traces 504 may be directly fed to the first set of radiating elements 506. The crossed dipole elements 506 may be interspersed with the annular ring elements 518. The crossed dipole elements 506 may be oriented so that the dipole elements are at approximately +45 degrees to vertical and −45 degrees to vertical to provide polarization diversity. The annular ring elements 518 may have two +/−45 degree polarizations, and may be also be used to provide polarization diversity. As best seen in FIG. 8B, the third layer conductive traces 516 may feed the second set of radiating elements 518.

Other types of radiating elements may be employed in keeping with the spirit of the disclosure. For example, box dipole elements may be substituted for the crossed dipole elements. In another example, box dipole elements may be substituted for the microstrip annular ring elements. In yet another example, dual-polarized patch elements, as described in U.S. Pat. No. 6,295,028, the contents incorporated herein by reference, may be used for both the first and second frequency bands.

Figure 9:
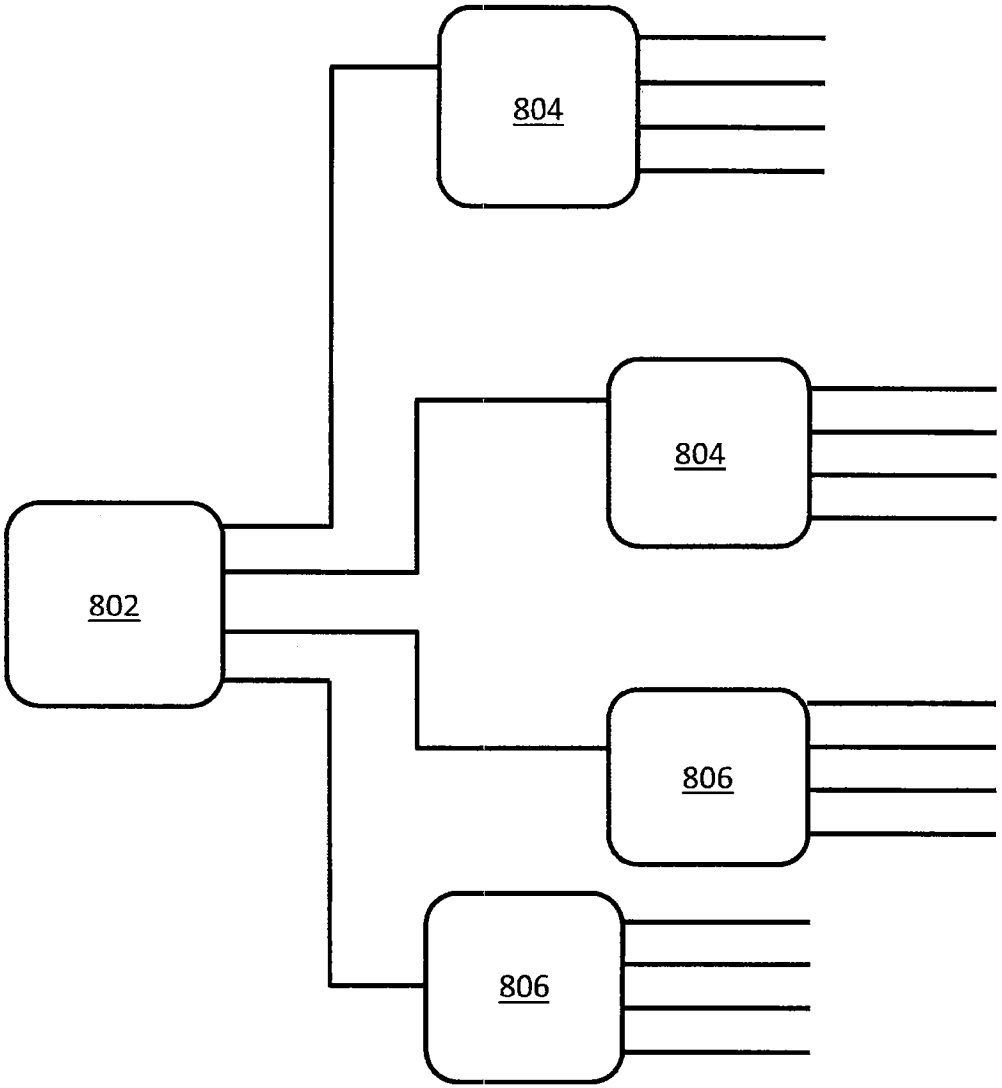
FIG. 9 is a block diagram illustrating an arrangement of phase shifters for a 6 foot multi-layer feed board according to an aspect of the present disclosure.
Figure 10A:
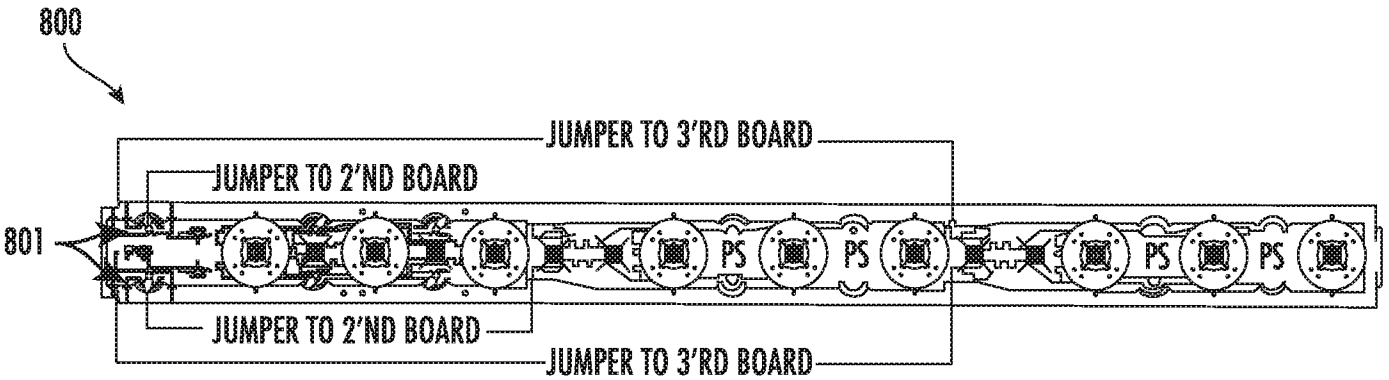
FIG. 10A is a plan view of the 6 foot multi-layer feed board according to an aspect of the present disclosure.
Figure 10B:
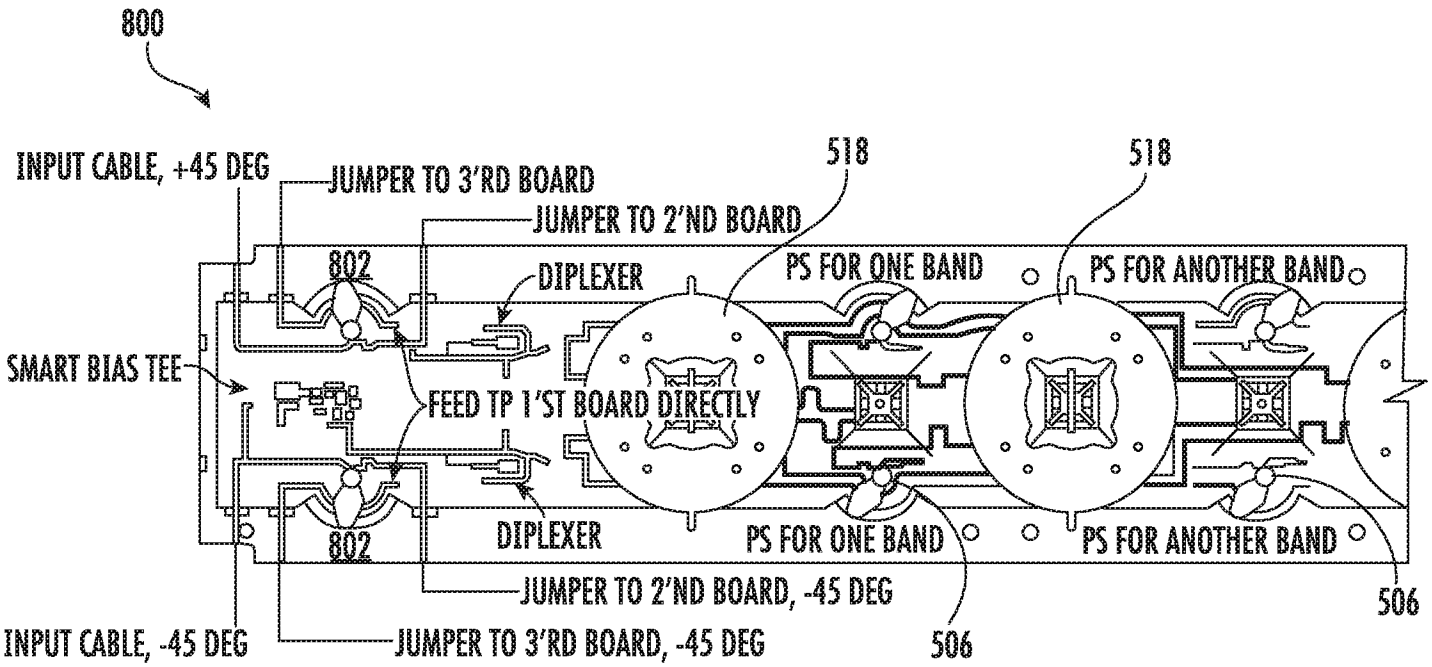
FIG. 10B is an enlarged view of a portion of the 6 foot multi-layer feed board according to an aspect of the present disclosure.
Figure 11A:
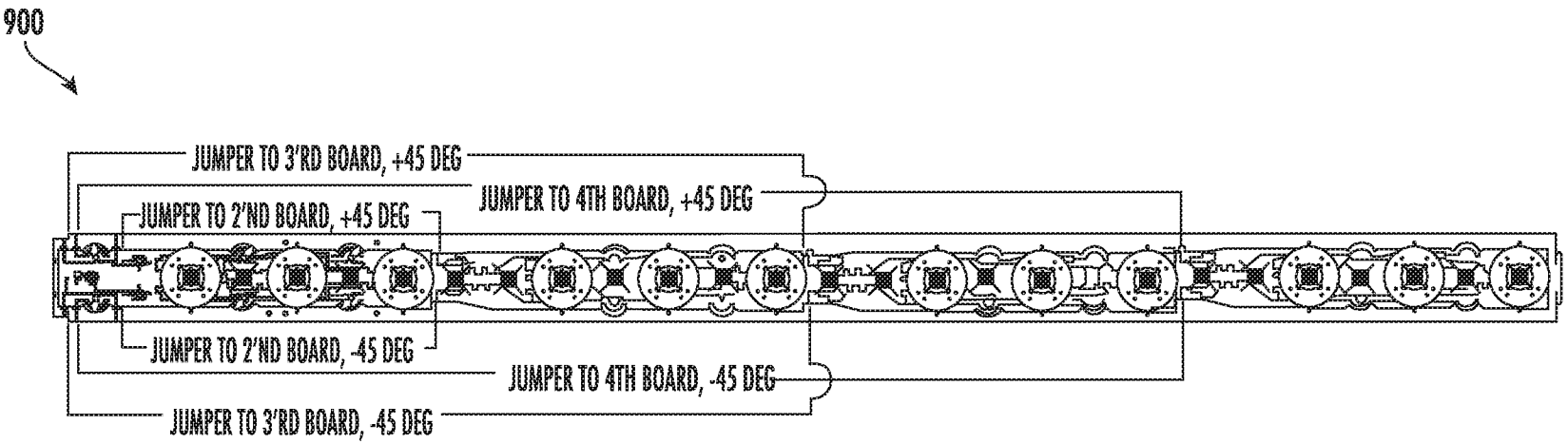
FIG. 11A is a plan view of an 8 foot multi-layer feed board according to an aspect of the present disclosure.
Figure 11B:
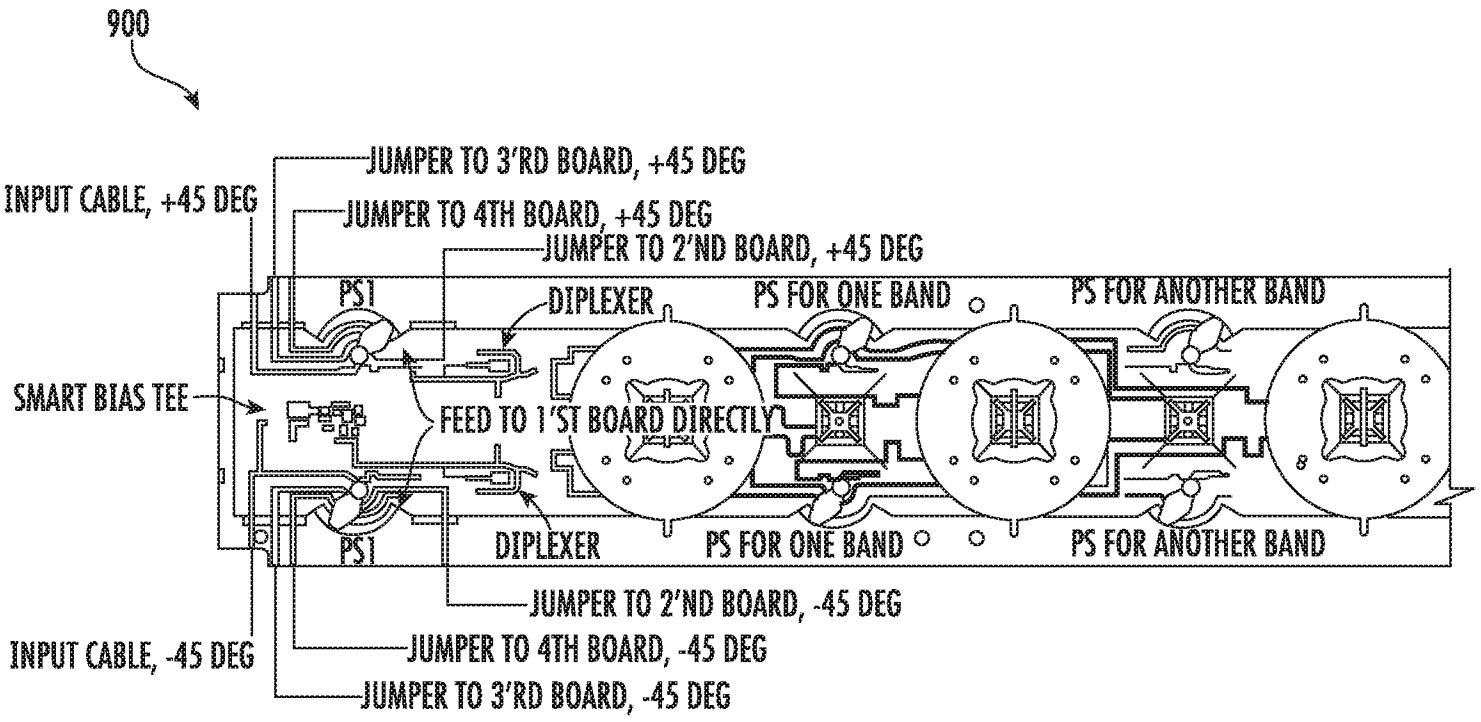
FIG. 11B is an enlarged view of a portion of the 8 foot multi-layer feed board according to an aspect of the present disclosure.

Aspects of the disclosure may be implemented with multi-layer feed boards of various lengths including, but not limited to 2 foot feed boards (such as described above), 6 foot, 8 foot, and greater length feed boards. With feed boards having lengths greater than 2 feet, one of the 2 foot multi-layer feed boards may take the form of a main feed board configured to feed the other 2 foot feed board portions. A block diagram of such an arrangement of the phase shifters for a 6 foot multi-layer feed board (800 as shown in FIG. 10) is shown in FIG. 9. The main feed board may include primary phase shifters 802, which may include one or more phase shifters for low band and high band phase shifting. Outputs of the primary phase shifters 802 may be coupled to inputs of phase shifters of the other multi-layer feed board portions. For example, two outputs of the primary phase shifter may be coupled to respective inputs of secondary phase shifters 804 employed on a second 2 foot multi-layer feed board portion. Another two outputs of the primary phase shifter 802 may be coupled to respective inputs of tertiary phase shifters 806 employed on a third 2 foot multi-layer feed board portion. As shown in the plan view of the 6 foot multi-layer feed board of FIG. 10A and the enlarged view of a portion of the same in FIG. 10B, the above discussed connections may be made via jumpers from the first 2 foot multi-layer feed board portion to the additional board portions. A similar arrangement may be applied to 8 foot multi-layer boards as well, an example multi-layer feed board 900 of which is shown in FIGS. 11A and 11B. More specifically, as shown, main board phase shifters PSI may include four outputs, one of which to feed phase shifters on the main board, $2^{nd}$ and $3^{rd}$ outputs to two middle 2 foot multi-layer board portions, and a $4^{th}$ output to the last 2 foot multi-layer board portion.

Various aspects of the disclosure have now been discussed in detail; however, the disclosure should not be understood as being limited to these embodiments. It should also be appreciated that various modifications, adaptations, and alternative embodiments thereof may be made within the scope and spirit of the present disclosure.

The invention claimed is:

1. A multi-band antenna, comprising:

a plurality of first radiating elements that are configured to transmit and receive signals in a first frequency band;

a plurality of second radiating elements that are configured to transmit and receive signals in a second frequency band that is different from the first frequency band; and a multi-layer feed board that includes a first conductive layer including at least one first component that is associated with operation in the first frequency band and a second conductive layer including at least one second component that is associated with operation in the second frequency band.

2. The multi-band antenna of claim 1, wherein the first radiating elements and the second radiating elements are mounted on the multi-layer feed board.

3. The multi-band antenna of claim 2, further comprising a reflector having a front side and a back side, wherein the multi-layer feed board, the first radiating elements and the second radiating elements are positioned on the front side of the reflector.

4. The multi-band antenna of claim 1, wherein the back side of the reflector does not have any feed board mounted thereon.

5. The multi-band antenna of claim 1, wherein the multi-layer feed board includes a first phase shifter that is configured to operate on signals in the first frequency band and a second phase shifter that is configured to operate on signals in the second frequency band.

6. The multi-band antenna of claim 1, wherein the first phase shifter and the second phase shifter are on the same layer of the multi-layer feed board.

7. The multi-band antenna of claim 1, wherein the multi-layer feed board further comprises at least one diplexer.

8. The multi-band antenna of claim 1, wherein a plurality of first conductive traces on a first signal trace layer of the multi-layer feed board connect to the respective first radiating elements, and a plurality of second conductive traces on a second signal trace layer of the multi-layer feed board connect to the respective second radiating elements.

9. The multi-band antenna of claim 1, wherein the multi-layer feed board includes at least two signal trace layers and at least two ground layers, and a plurality of insulating layers.

10. A multi-layer feed board for an antenna, the multi-layer feed board comprising:

a first conductive layer including at least one first component associated with operation of the antenna in a first frequency band; and a second conductive layer including at least one second component associated with operation of the antenna in a second frequency band different than the first frequency band.

11. The multi-layer feed board of claim 10, wherein the first conductive layer comprises a first signal trace layer, the second conductive layer comprises a second signal trace layer, the multi-layer feed board further comprising a first ground layer that is between the first signal trace layer and the second signal trace layer and a second ground layer, wherein the second signal trace layer is between the first and second ground layers.

12. The multi-layer feed board of claim 11, further comprising a first insulating layer between the first signal trace layer and the first ground layer, a second insulating layer between the first ground layer and the second signal trace layer and a third insulating layer between the second signal trace layer and the second ground layer.

13. The multi-layer feed board of claim 12, further comprising a diplexer that is formed on one of the first and second signal trace layers.

14. The multi-layer feed board of claim 11 in combination with a reflector and a plurality of first frequency band radiating elements and a plurality of second frequency band radiating elements, wherein the first and second radiating elements are mounted on and electrically connected to the multi-layer feed board, and wherein the first and second radiating elements extend from the multi-layer feed board away from the reflector.

15. The multi-layer feed board of claim 14, wherein the electrical connections between the first frequency band radiating elements and the multi-layer feed board are on one of the first or second signal trace layers and the electrical connections between the second frequency band radiating elements and the multi-layer feed board are on the other of the first or second signal trace layers.

16. The multi-layer feed board of claim 15, wherein one of the first or second signal trace layers includes both a first frequency band phase shifter that is coupled to at least some of the first frequency band radiating elements and a second frequency band phase shifter that is coupled to at least some of the second frequency band radiating elements.

17. A multi-band antenna, comprising:

a multi-layer feed board that includes a first signal trace layer, a first insulating layer, a first ground layer, a second insulating layer, a second signal trace layer, a third insulating layer, and a second ground layer that are sequentially stacked;

a plurality of first radiating elements that are configured to transmit and receive signals in a first frequency band, the first radiating elements mounted on the multi-layer feed board; and a plurality of second radiating elements that are configured to transmit and receive signals in a second frequency band that is different from the first frequency band, the second radiating elements mounted on the multi-layer feed board; and wherein the first signal trace layer includes at least one first frequency band phase shifter and at least one second frequency band phase shifter.

18. The multi-band antenna of claim 17, wherein a diplexer is provided on either the first signal trace layer or the second signal trace layer.

19. The multi-band antenna of claim 17, further comprising a reflector, wherein the multi-layer feed board and the first and second radiating elements are positioned forwardly of the reflector.

20. The multi-band antenna of claim 18, wherein the multi-layer feed board includes a plated through hole that connects an output of the diplexer to at least one of the second radiating elements.

* * * * *